US007961155B2

(12) United States Patent
Chen et al.

(10) Patent No.: US 7,961,155 B2
(45) Date of Patent: Jun. 14, 2011

(54) ANTENNA AUXILIARY SUPPORT

(75) Inventors: Yi-Dun Chen, Taipei (TW); Lan-Chun Yang, Taipei (TW); Hung-Yuan Lin, Taipei (TW)

(73) Assignee: Wistron NeWeb Corp., Hsinchu (TW)

( * ) Notice: Subject to any disclaimer, the term of this patent is extended or adjusted under 35 U.S.C. 154(b) by 365 days.

(21) Appl. No.: 12/328,721

(22) Filed: Dec. 4, 2008

(65) Prior Publication Data

US 2009/0243954 A1 Oct. 1, 2009

(30) Foreign Application Priority Data

Mar. 28, 2008 (TW) ..... 97111266 A

(51) Int. Cl.
*H01Q 1/12* (2006.01)

(52) U.S. Cl. ..... 343/878

(58) Field of Classification Search ..... 343/878, 343/874, 792–793, 765–766
See application file for complete search history.

(56) References Cited

U.S. PATENT DOCUMENTS

| | | | | |
|---|---|---|---|---|
| 5,355,145 | A * | 10/1994 | Lucas | 343/882 |
| 6,727,861 | B2 * | 4/2004 | Antoine | 343/878 |
| 6,930,649 | B1 * | 8/2005 | Sergi | 343/792.5 |
| 7,683,853 | B2 * | 3/2010 | Michaelis | 343/878 |
| 2007/0139292 | A1 * | 6/2007 | Harless et al. | 343/878 |

* cited by examiner

*Primary Examiner* — Huedung Mancuso

(57) ABSTRACT

An antenna auxiliary support is provided, including two tubes, a fixed base, a first fixing element and a second fixing element. One of the tubes is connected to the fixed base and comprises two clipping portions and two gaps. The gaps are disposed between the clipping portions. The tubes are telescopically connected. The clipping portions respectively comprise an inner surface. The inner surface is an uneven surface. The fixed base and the first fixing element are respectively connected to the tubes. The second fixing element is disposed over the clipping portions and the gaps to fix the connecting position of the tubes.

10 Claims, 5 Drawing Sheets

ANTENNA AUXILIARY SUPPORT

CROSS REFERENCE TO RELATED APPLICATIONS

This Application claims priority of Taiwan Patent Application No. 097111266, filed on Mar. 28, 2008, the entirety of which is incorporated by reference herein.

BACKGROUND OF THE INVENTION

1. Field of the Invention

The invention relates to an antenna auxiliary support.

2. Description of the Related Art

Generally, an antenna is provided to receive image signals. The antenna (for example, a parabolic antenna) is usually installed outside. The antenna includes a plate and a main support. The shape of the plate is not aerodynamically designed to prevent wind resistance. Thus, the main support is usually designed as a single and unitary member for decreased wind resistance. Further, an auxiliary support is installed to enhance prevention of wind resistance by the main support. Thus, the parabolic antenna is installed and firmly fixed outside.

BRIEF SUMMARY OF THE INVENTION

The invention provides an antenna auxiliary support including two tubes, a fixed base, a first fixing element and a second fixing element. One of the tubes is connected to the fixed base and comprises two clipping portions and two gaps. The gaps are disposed between the clipping portions. The tubes are telescopically connected. The clipping portions respectively comprise an inner surface. The inner surface is an uneven surface. The fixed base and the first fixing element are respectively connected to the tubes. The second fixing element is disposed over the clipping portions and the gaps for fixing the connecting position of the tubes.

Note that the inner diameter of the tubes is different. The inner diameter of the tube connected to the fixed base is greater than the inner diameter of the other tube.

Note that the clipping portions and the gaps are disposed on the tube with the greater inner diameter connected to the fixed base.

Note that the inner diameters of the tubes are different. The inner diameter of the tube connected to the first fixing element is greater than the inner diameter of the other tube.

Note that the clipping portions and the gaps are disposed on the tube with the greater inner diameter connected to the first fixing element.

Note that the tubes comprise a first connecting end and a second connecting end, wherein the first connecting end is connected to the fixed base and the second connecting end is connected to the first fixing element.

Note that the fixed base comprises an opening, a linking portion and a through hole, wherein the linking portion is punched to form the opening and the through hole is disposed on the linking portion.

Note that the antenna auxiliary support further comprises a first screw and a first screw bolt, wherein the first screw passes through the through hole and the first connecting end, and then is fixed via the first screw bolt.

Note that the first fixing element and the second fixing element respectively comprises a ring-shaped portion, two adjusting portions, a protrusion and two fixed holes. The ring-shaped portion is connected to the adjusting portions. The fixed holes are correspondingly disposed on the adjusting portions. The protrusion is disposed on one of the adjusting portions. The adjusting portions of the first fixing element are connected to the second connecting end.

Note that the antenna auxiliary support further comprises a second screw and a second screw bolt. The second screw passes through the fixed holes of the first fixing element and the second connecting end, and then is fixed via the second screw bolt.

Note that the antenna auxiliary support further comprises a third screw and a third screw bolt. The third screw passes through the fixed holes of the second fixing element, and then is fixed via the third screw bolt.

Note that the uneven surface comprises a threading surface.

The invention can be more fully understood by reading the subsequent detailed description and examples with references made to the accompanying drawings, wherein:

DETAILED DESCRIPTION OF THE INVENTION

Figure 1:
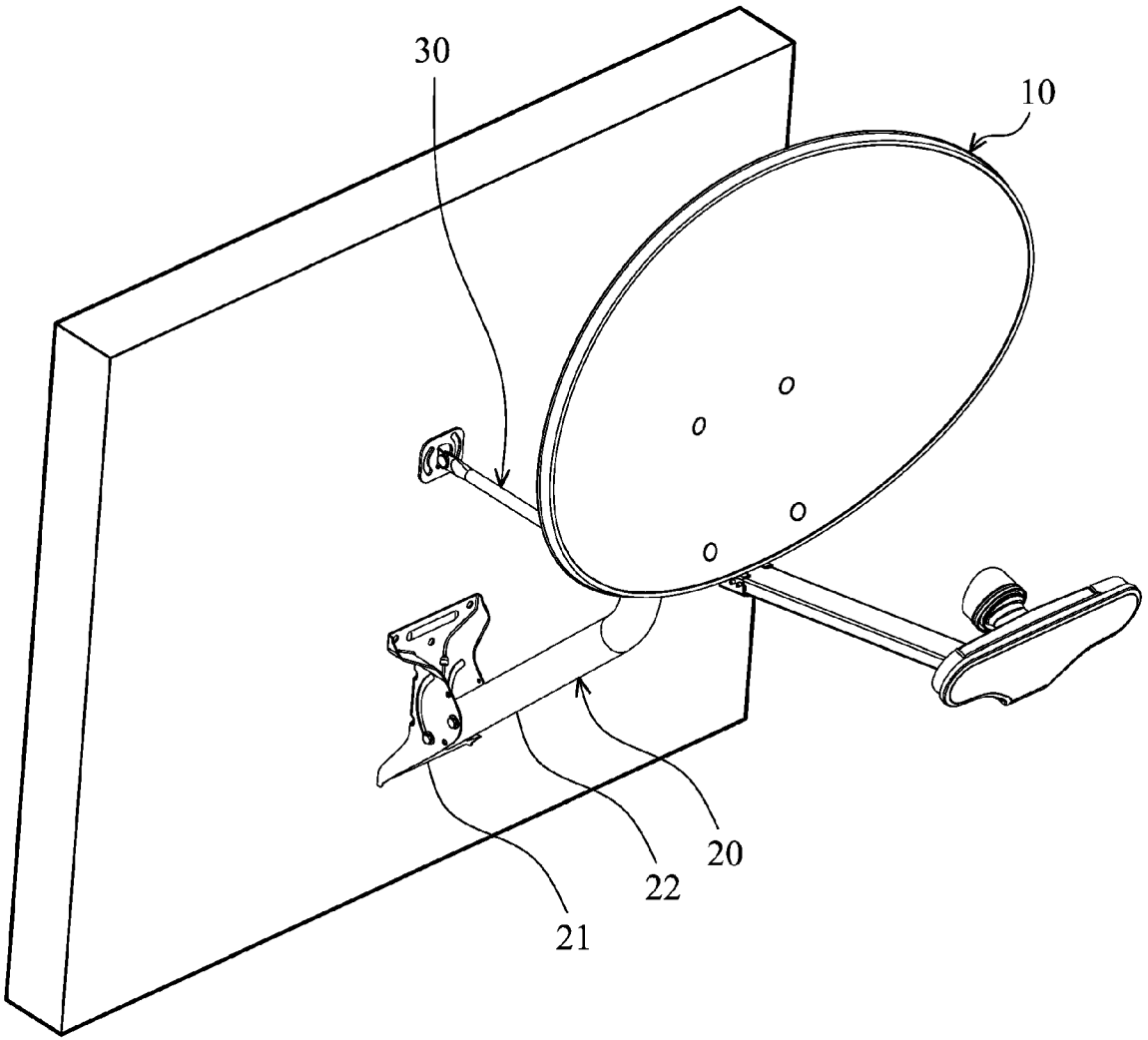
FIG. 1 is a schematic view of an antenna auxiliary support according to an embodiment of the invention applied to a parabolic antenna.

FIG. 1 is a schematic view of an antenna auxiliary support according to an embodiment of the invention applied to a parabolic antenna. Referring to FIG. 1, the parabolic antenna 10 is supported by a main support 20. The main support 20 comprises a supporting bar 22 and a main base 21. The main base 21 is fixed on a wall. Two ends of the supporting bar 22 are respectively connected to the main base 21 and the parabolic antenna 10. An antenna auxiliary support 30 is fixed on the wall and connected to the main support 20 to enhance prevention of wind resistance by the main support 20.

Figure 2:
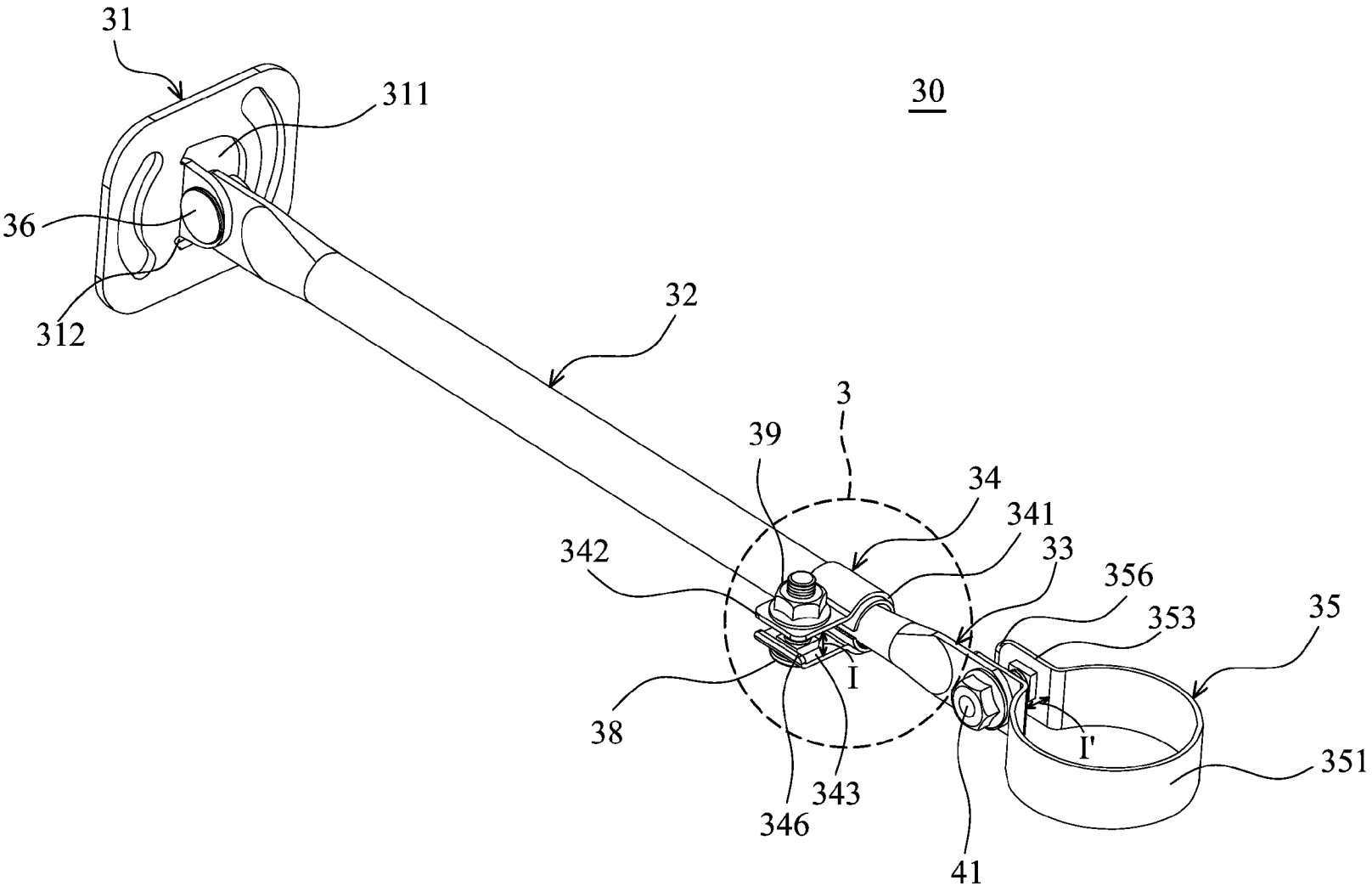
FIG. 2 is a schematic view of an antenna auxiliary support according to an embodiment of the invention.
Figure 3:
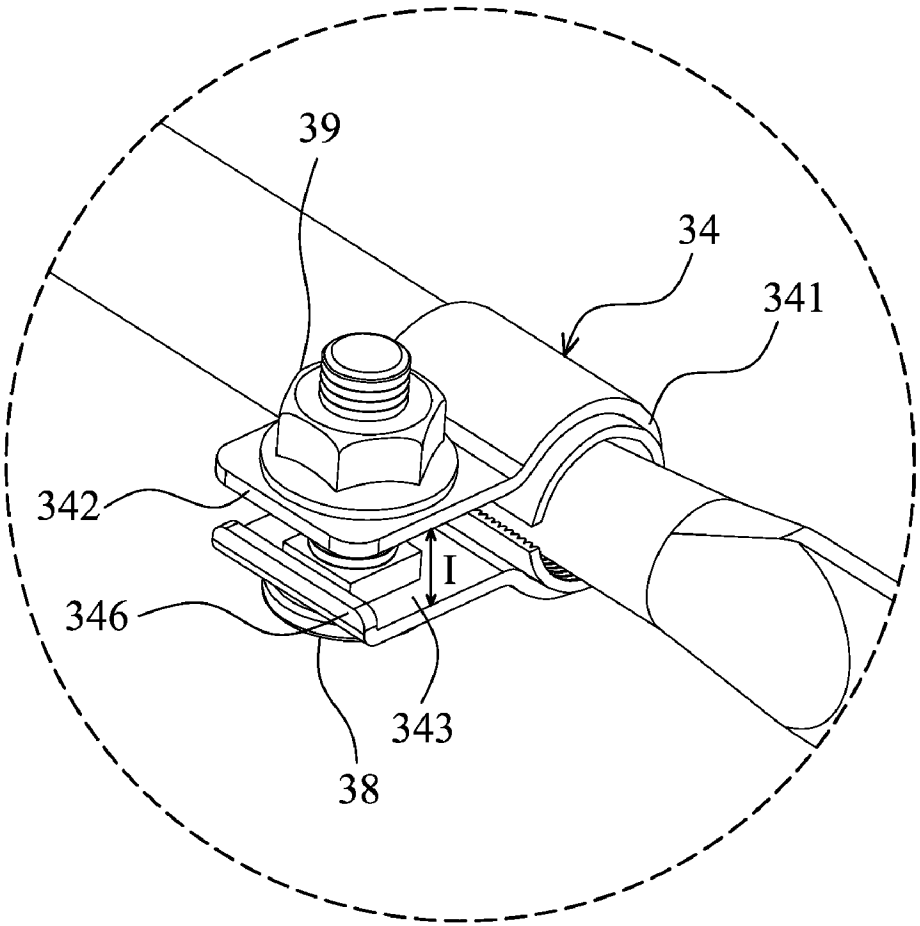
FIG. 3 is a partial enlarged view of FIG. 2.
Figure 4:
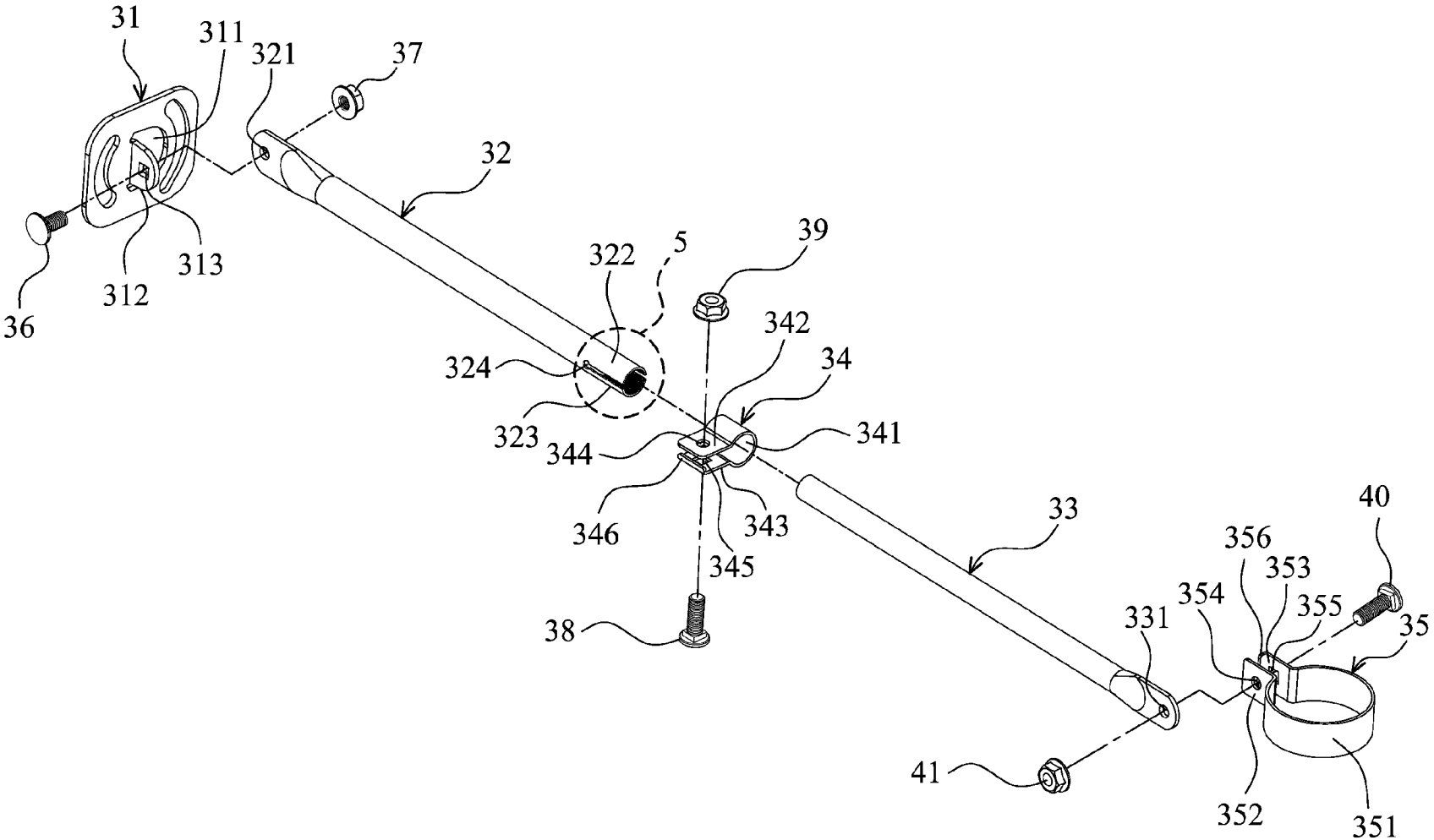
FIG. 4 is an exploded view of an antenna auxiliary support according to an embodiment of the invention.

Referring to FIGS. 2-5, FIG. 2 is a schematic view of an antenna auxiliary support according to an embodiment of the invention, FIG. 3 is a partial enlarged view of FIG. 2, and FIG. 4 is an exploded view of an antenna auxiliary support according to an embodiment of the invention. First, referring to FIG. 4, the antenna auxiliary support 30 comprises a fixed base 31, two tubes 32 and 33, a first fixing element 35, a second fixing element 34, a first screw 36, a first screw bolt 37, a second screw 40, a second screw bolt 41, a third screw 38 and a third screw bolt 39.

The fixed base 31 comprises an opening 311, a linking portion 312 and a through hole 313. The fixed base 31 is punched to form the opening 311 and a bent linking portion 312. The through hole 313 is disposed on the linking portion 312.

Figure 5:
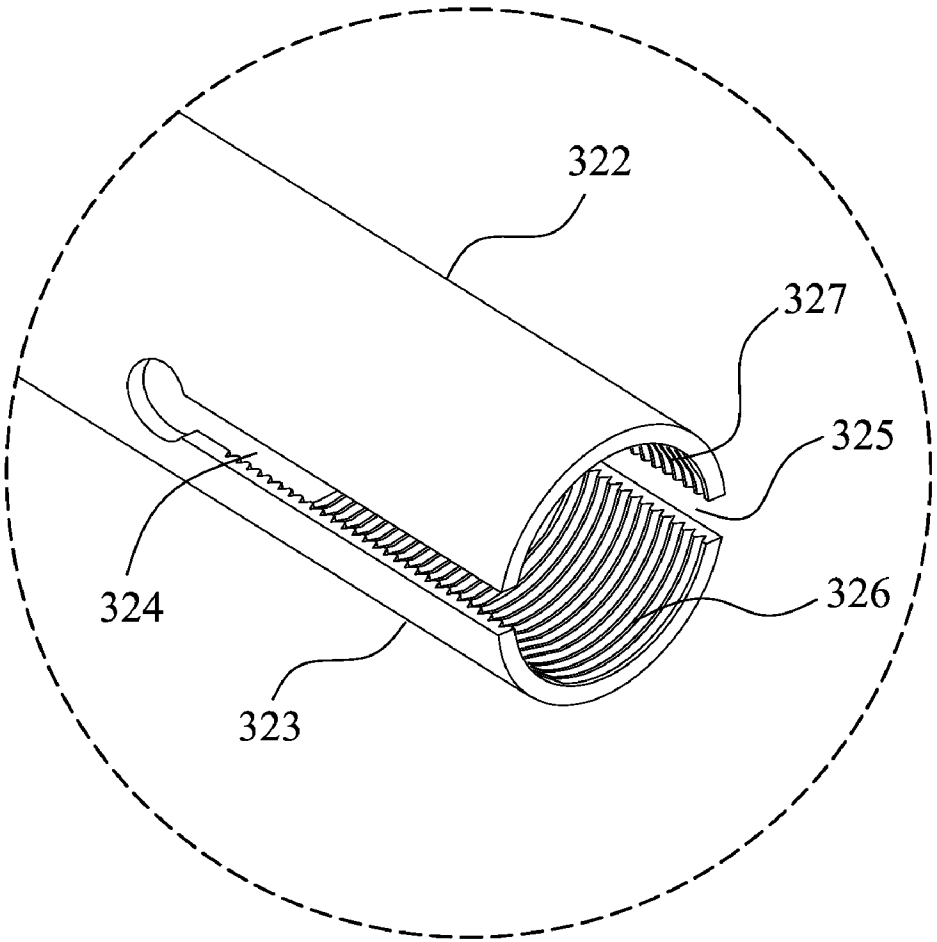
FIG. 5 is a partial enlarged view of FIG. 4.

The tube 32 comprises a first connecting end 321, two clipping portions 322 and 323, and two gaps 324 and 325 (shown in FIG. 5, FIG. 5 is a partial enlarged view of FIG. 4). The first connecting end 321 is connected to the fixed base 31. The clipping portions 322 and 323 respectively comprise two inner surfaces 327 and 326. The inner surfaces 327 and 326 are uneven surface. In this embodiment, the inner surfaces 327 and 326 are threading surfaces. However, the invention is not limited to the disclosed embodiment. The inner surfaces 327 and 326 may be designed as other uneven surfaces. The tube 33 comprises a second connecting end 331. The second connecting end 331 is connected to the first fixing element 35.

The first fixing element 35 comprises a ring-shaped portion 351, two adjusting portions 352 and 353, a protrusion 356 and two fixed holes 354 and 355. The ring-shaped portion 351 is connected to the adjusting portions 352 and 353. The fixed holes 354 and 355 are correspondingly disposed on the adjusting portions 352 and 353. The protrusion 356 is disposed on the adjusting portion 353.

Similarly, the second fixing element 34 comprises a ring-shaped portion 341, two adjusting portions 342 and 343, a protrusion 346 and two fixed holes 344 and 345. The ring-shaped portion 341 is connected to the adjusting portions 342 and 343. The fixed holes 344 and 345 are correspondingly disposed on the adjusting portions 342 and 343. The protrusion 346 is disposed on the adjusting portion 343.

Referring to FIGS. 2 and 4, the through hole 313 on the linking portion 312 of the fixed base 31 is connected to the first connecting end 321 of the tube 32 during the assembly of the antenna auxiliary support 30. In this embodiment, the first connecting end 321 is a hole. The first screw 36 passes through the through hole 313 and the first connecting end 321, and then is fixed via the first screw bolt 37. Thus, the tube 32 is fixed on the fixed base 31.

Referring to FIGS. 2, 3 and 4, the inner diameters of the tubes 32 and 33 are different to form a telescopic structure. In this embodiment, the inner diameter of the tube 32 connected to the fixed base 31 is greater than the inner diameter of the tube 33. The clipping portions 322 and 323 and the gaps 324 and 325 (shown in FIG. 5) are disposed on the tube 32. When the tube 33 retracts into the tube 32, the clipping portions 322 and 323 provide greater allowance via the gaps 324 and 325 for easy assembly. After the tubes 32 and 33 are telescopically connected, the ring-shaped portion 341 of the second fixing element 34 is installed on the clipping portions 322 and 323 and the gaps 324 and 325 (shown in FIG. 5). The third screw 38 passes through the fixed holes 345 and 344, and then is fixed via the third screw bolt 39. The interval I between the adjusting portions 342 and 343 is adjusted to tightly fasten the tubes 32 and 33 and limit the connection of the tubes 32 and 33. When the interval I between the adjusting portions 342 and 343 is pressed to a minimum interval, the protrusion 346 props against the adjusting portion 342 to avoid excessive deformation of the adjusting portions 342 and 343. The clipping portions 322 and 323 comprise two inner surfaces 327 and 326. The inner surfaces 327 and 326 are uneven surfaces to increase friction, when the bars 32 and 33 are connected. In other embodiments, the inner diameter of the tube 33 connected to the first fixing element 35 may be designed to be greater than the inner diameter of the tube 32. The clipping portions 322 and 323 and the gaps 324 and 325 are disposed on the tube 33 (not shown).

Referring to FIGS. 1, 2 and 4, after the ring-shaped portion 351 of the first fixing element 35 passes through the supporting bar 22 of the main support 20, the second connecting end 331 of the tube 33 is connected to the adjusting portion 352 of the first fixing element 35. The second screw 40 passes through the fixed holes 355 and 354 of the first fixing element 35 and the second connecting end 331, and then is fixed via the second screw bolt 41. Then, the interval I' between the adjusting portions 352 and 353 is adjusted to tightly fasten the supporting bar 22 and first fixing element 35 and limit the connection of the supporting bar 22 and first fixing element 35. When the interval I' between the adjusting portions 352 and 353 is pressed to a minimum interval, the protrusion 356 props against the adjusting portion 352 to avoid excessive deformation of the adjusting portions 352 and 353.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna auxiliary support, comprising:

a fixed base, comprising an opening, a linking portion and a through hole, wherein the linking portion is punched to form the opening and the through hole is disposed on the linking portion;

two tubes, telescopically connected each other, wherein one of the tubes is connected to the fixed base and comprises two clipping portions and two gaps, wherein the gaps are disposed between the clipping portions, and the clipping portion respectively comprises an inner surface, wherein the inner surface is an uneven surface;

a first fixing element, wherein the fixed base and the first fixing element respectively connect to the tubes, wherein the tubes comprise a first connecting end and a second connecting end, the first connecting end is connected to the fixed base, and the second connecting end is connected to the first fixing element; and a second fixing element, installed on the clipping portion and the gaps to fix the connection of the tubes.

2. The antenna auxiliary support as claimed in claim 1, wherein the inner diameters of the tubes are different, and the inner diameter of the tube connected to the fixed base is greater than the inner diameter of the other tube.

3. The antenna auxiliary support as claimed in claim 2, wherein the clipping portions and the gaps are disposed on the tube with the greater inner diameter connected to the fixed base.

4. The antenna auxiliary support as claimed in claim 1, wherein the inner diameters of the tubes are different, and the inner diameter of the tube connected to the first fixing element is greater than the inner diameter of the other tube.

5. The antenna auxiliary support as claimed in claim 4, wherein the clipping portions and the gaps are disposed on the tube with the greater inner diameter connected to the first fixing element.

6. The antenna auxiliary support as claimed in claim 1, further comprising a first screw and a first screw bolt, wherein the first screw passes through the through hole and the first connecting end, and then is fixed via the first screw bolt.

7. The antenna auxiliary support as claimed in claim 1, wherein the first fixing element and the second fixing element respectively comprises a ring-shaped portion, two adjusting portions, a protrusion and two fixed holes, wherein the ring-shaped portion is connected to the adjusting portions, the fixed holes are correspondingly disposed on the adjusting portions, the protrusion is disposed on one of the adjusting portions, and the adjusting portions of the first fixing element are connected to the second connecting end.

8. The antenna auxiliary support as claimed in claim 7, further comprising a second screw and a second screw bolt, wherein the second screw passes through the fixed holes of the first fixing element and the second connecting end, and then is fixed via the second screw bolt.

9. The antenna auxiliary support as claimed in claim 7, further comprising a third screw and a third screw bolt, wherein the third screw passes through the fixed holes of the second fixing element, and then is fixed via the third screw bolt.

10. The antenna auxiliary support as claimed in claim 1, wherein the uneven surface comprises a threading surface.

* * * * *